United States Patent [19]

Kawada et al.

[11] 4,131,206

[45] Dec. 26, 1978

[54] AUTOMATIC APPARATUS FOR FURNISHING WEB IN ROTARY PRESS

[75] Inventors: Tomoshi Kawada, Kawasaki; Yuichi Okamura, Tokyo, both of Japan

[73] Assignees: Kabushiki Kaisha Tokyo Seisakusho; Kabushiki Kaisha Kaneda Kikai Seisakusho, both of Japan

[21] Appl. No.: 817,432

[22] Filed: Jul. 20, 1977

[30] Foreign Application Priority Data

Mar. 4, 1977 [JP] Japan ..... 52-24127

[51] Int. Cl.[2] ..... B66F 9/14

[52] U.S. Cl. ..... 214/1 BB; 242/58.6; 242/79

[58] Field of Search ..... 214/1 BB, 1 BD, DIG. 4; 242/79, 58.6

[56] References Cited

U.S. PATENT DOCUMENTS

| | | | |
|---|---|---|---|
| 2,527,667 | 10/1950 | Wood | 242/79 |
| 2,802,586 | 8/1957 | Wingard | 242/79 |
| 3,345,014 | 10/1967 | Shearn | 242/79 |
| 3,351,299 | 11/1967 | Fehr | 242/79 |
| 3,374,963 | 3/1968 | Conti | 242/58.6 |
| 3,872,979 | 3/1975 | Riedner | 214/1 BB |

*Primary Examiner*—Albert J. Makay
*Assistant Examiner*—Ross Weaver

[57] ABSTRACT

A double truck mechanism consists of a first truck adapted to move along first rails extending parallel to a reel shaft and support a new web loaded on it and a second truck adapted to move along second rails extending right beneath and at right angles to the reel shaft and the first rails and support the first truck brought and loaded onto it, the second truck being provided with a main lifter for lifting and lowering the loaded first truck, the mechanism includes a pair of web core collecting mechanisms on the second truck and mechanism for mounting and demounting the web core and a sequential control mechanism for controlling one cycle operation of the individual mechanisms.

20 Claims, 17 Drawing Figures

AUTOMATIC APPARATUS FOR FURNISHING WEB IN ROTARY PRESS

BACKGROUND OF THE INVENTION

This invention relates to an automatic apparatus for furnishing each web reel of a rotary press with a new web, while also removing a web core after use from the reel and bringing away the removed web core.

Hitherto, it has been in practice to furnish the web reel of the rotary press with a web by providing rails leading from a web storate house up to a position right beneath each reel, bringing the new web loaded on a truck to a position right beneath the reel by moving the truck and then mounting the web between the ends of given mating arms of tri-fulcated arm members in pair by manual operation or by means of a lifter.

With recent increase of printing speed, for instance to an order of 700 meters per minute, at which speed the standard web is consumed in about 10 minutes, there is a tendency of simultaneously operating a number of rotary presses interlocked to one another, and thus the frequency of supplying web is widely increased. However, it requires very sofisticated skill to mount a very heavy web of a weight in excess of 600 kg on the reel speedily and reliably in a very short period of time by determining the position of the web in the directions of width, height and depth of the reel, and the mounting of the new web is retarded even if a very slight error is produced in the position of mounting the new web on a truck, position of stopping of the truck, position of lifting of the web and so forth; in such case, it becomes no longer possible to keep pace with the high speed printing.

In another aspect, it has been in practice to let the web core after use to fall from the arm ends onto floor when the tri-fulcated arm members of the reel is in its lowermost position and collect the rolling web core and bring it away by manual operation.

However, when the operation of mounting the new web is very time-consuming, the removed web core is likely to be left on the floor and thus constitute an obstacle to the operation since it can not be brought away quickly and reliably.

A first object of the invention is to provide a perfectly automatic apparatus for furnishing web, which not only permits a new web brought in on a truck to be automatically mounted on a reel by automatically, quickly and precisely positioning it in the direction of width, height and depth of the reel but also permits each web core after use to be automatically collected on the truck in a closely interlocked relation to the automatic supply of a new web and be automatically brought away.

A second object of the invention is to realize high speed operation of a rotary press by realizing perfectly automatic, quick and reliable furnishing of web.

SUMMARY OF THE INVENTION

In summary, the construction contemplated in the instant invention comprises a double truck mechanism for supplying new web, said mechanism consisting of a first truck (hereinafter sometimes referred to as truck) adapted to move along first rails extending parallel to a reel shaft and support a new web loaded on it and a second truck adapted to move along second rails extending right beneath and at right angles to said reel shaft and said first rails and support said first truck brought and loaded onto it, said second truck (hereinafter sometimes referred to as traverser) being provided with a main lifter for lifting and lowering the loaded first truck, a pair of web core collecting mechanisms provided on said second truck adjacent to the opposite ends thereof, each said web core collecting mechanism being either of stationary type or capable of both vertical movement and inclination, a mechanism for mounting and demounting a web core by causing advancement or retreat of center collars provided at mating ends of mating arms of pair tri-fulcated arm members of said reel shaft, and a sequential control mechanism for controlling one cycle operation of the afore-mentioned individual mechanisms, namely a mechanism for causing completion of the positioning of the new web in the width direction thereof at the instant of bringing the first truck onto the second truck, completing the removal and collection of the web after use and positioning of the new web in the direction of height of the reel in a sequential fashion during the course of movement of the second truck in the direction of depth of the reel, subsequently completing the positioning of the new web in the direction of depth of the reel, then mounting the new web by causing advancement of the center collars and restoring the double track mechanism to the start position thereof, the collected web core being automatically transferred to the first truck in case where the pair of web core collecting mechanisms are of the type capable of both vertical movement and inclination.

BRIEF DESCRIPTION OF THE DRAWINGS

The drawings illustrate a specific embodiment of the invention, and in which:

FIG. 5 being a plan view to an enlarged scale; and

FIGS. 6 to 9 being sections taken along respective lines 6—6 to 9—9 in FIG. 5 for illustrating the sequence of the operation of positioning the first truck brought onto the second truck (i.e., traverser);

DESCRIPTION OF THE PREFERRED EMBODIMENT

Figure 1:
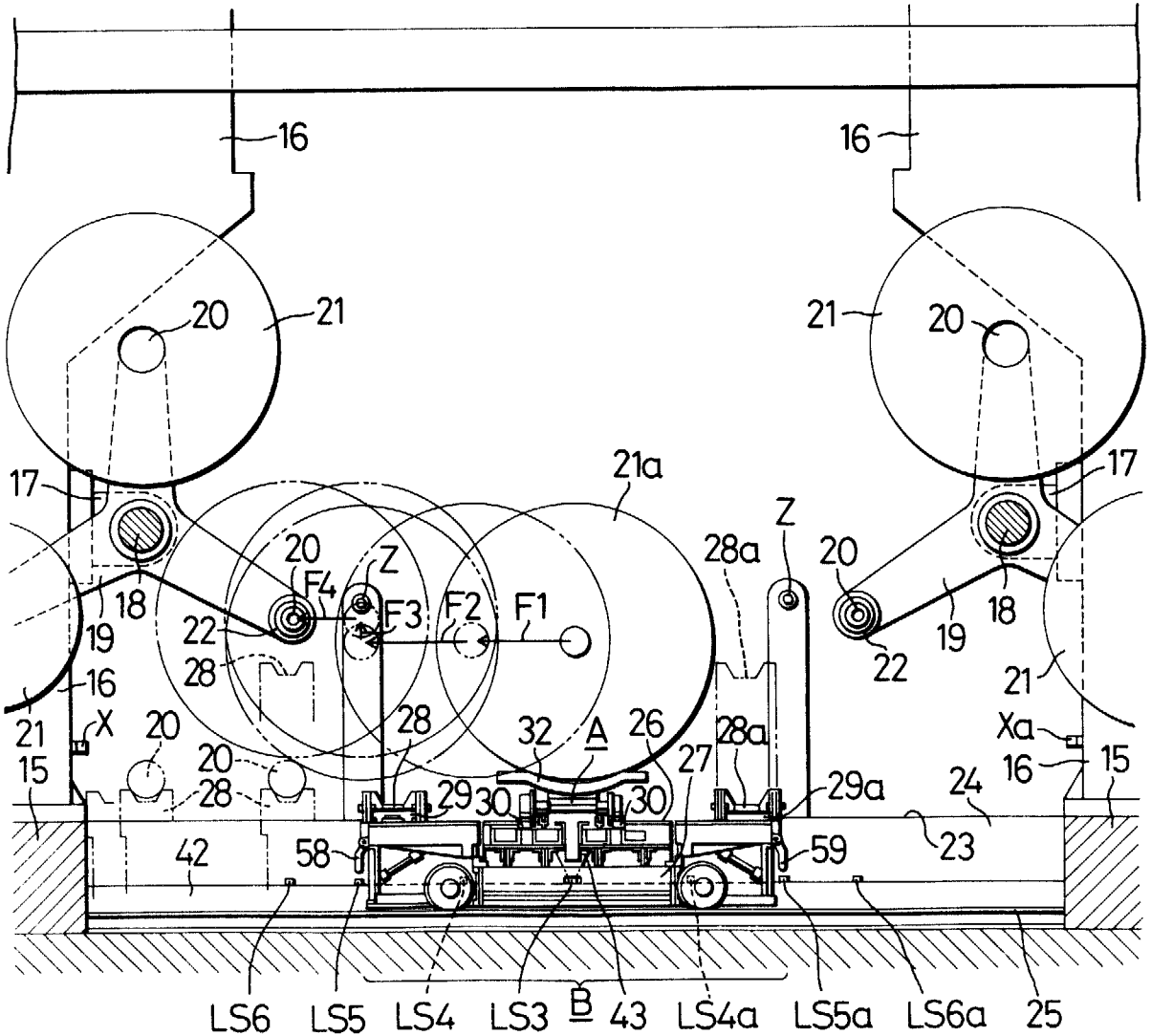
FIG. 1 is an elevational view.
Figure 2:
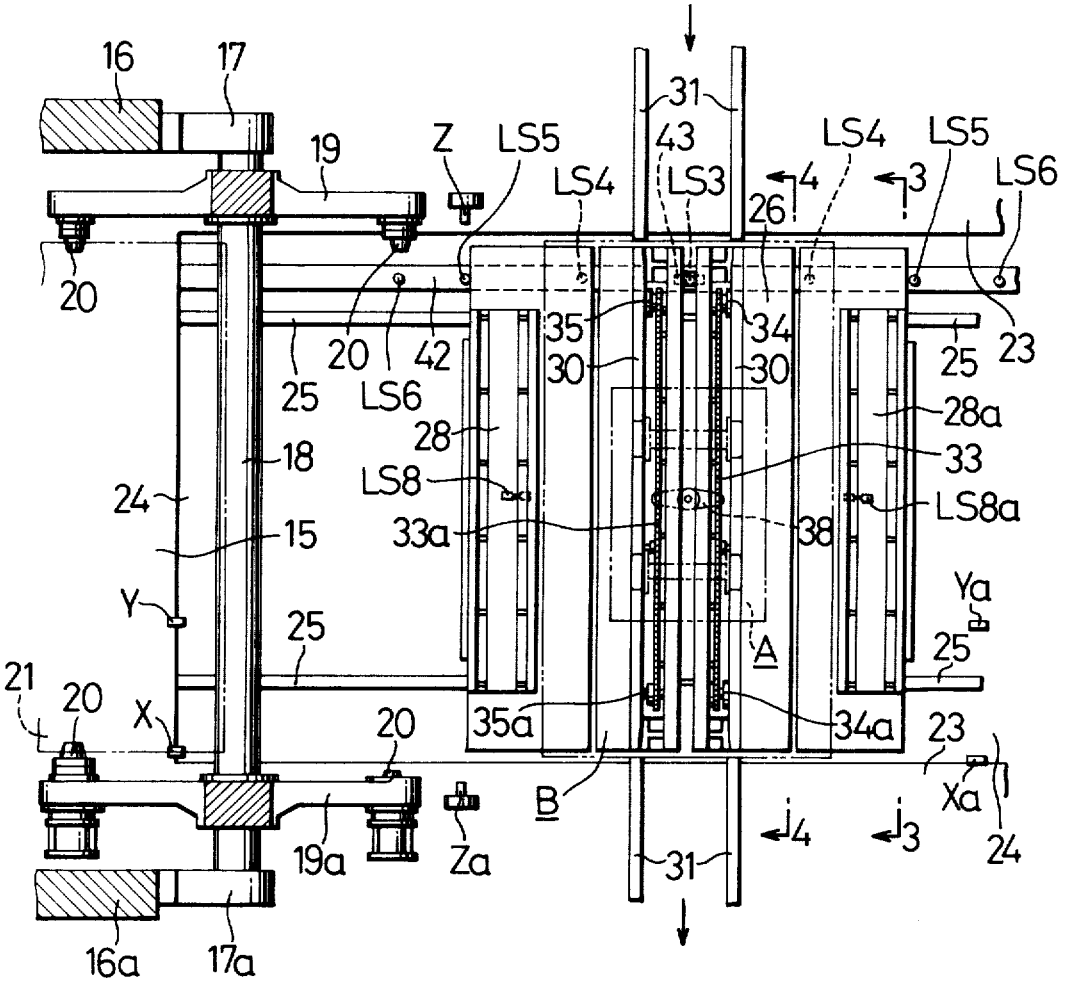
FIG. 2 is a plan view.

Referring to FIGS. 1 and 2, there is shown a well-known mechanism for mounting and furnishing web. It comprises Y-shaped frames 16 and 16a erected upright from an underbed 15, brackets 17 and 17a projecting sidewise from the Y-shaped frames, reel shaft 18 each supported between associated brackets, and tri-fulcated arm members 19 and 19a projecting from the opposite ends of each reel. Webs 21 are each mounted between center collars 20 provided on the ends of mating arms of associated pair tri-fulcated arm members, that is, three webs are mounted on each reel. These webs 21 mounted between the ends of mating arms of the pair tri-fulcated arm members are successively consumed with intermittent revolution of the reel, and web cores 22 after use are brought to a lower position in the revolution.

Such web mounting and furnishing mechanism is provided one set for each rotary press which effects eight-page newspaper printing. Thus, where several rotary presses are provided in a row to meet the printing and issuing of newspapers having a greater number of pages, reels are also arranged parallel at a predetermined interval as shown in FIG. 1.

In a specific embodiment of the invention shown in the drawings, a recess 24 is provided on a floor 23 between pair underbeds 15 constituting the base for the respective Y-shaped frames 16 supporting the respective reels, and rails 25 are laid on the bottom of the recess such that they extend in a direction at right angles to the reel shafts 18. The opposite ends of the rails reach positions right beneath the reel shafts 18, and a truck B (hereinafter referred to as traverser) is provided such that it is moved along the rails.

The traverser B includes a central base 26 for supporting a first truck A (hereinafter referred to as truck) and a lifter 27 (hereinafter referred to as main lifter) for lifting the truck, and it is provided on its opposite ends with respective web core receptacles 28 and 28a in pair and lifters 29 and 29a (hereinafter referred to as web core lifters) for lifting the respective web core receptacles. It is also provided with a drive mechanism, that is, four wheels and a motor (not shown) provided with brake and clutch. The level of the top surface of the truck support base 26 is made to coincide with the level of the floor 23.

Rails 30 for bringing in the truck A are laid on the support base 26 of the traverser B parallel to the reel shafts 18. In the start position of the traverser B (in FIGS. 1 and 2) the opposite ends of the rails 30 are in contact with corresponding ends of rails 31 laid on the floor. The rails 31 extend along a path not shown and reach a web storage house, and a new web 21a is taken out of the storage house and loaded on a base 32 on the truck A, and it is manually transported toward the bring-in rails 30 on the traverser B.

Figure 8:
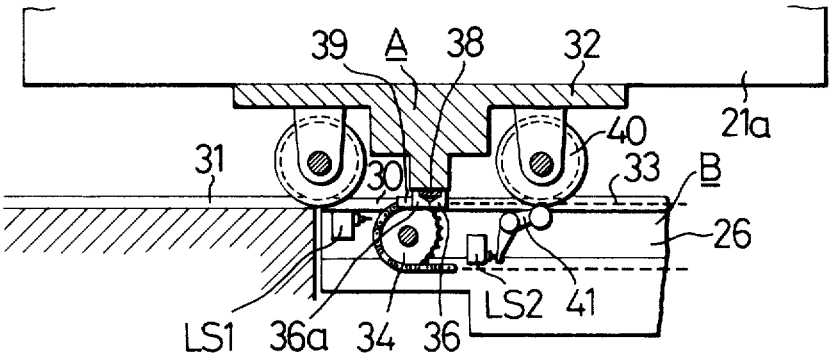

FIGS. 5 to 9 show details of the mechanism for bringing the truck with the new web 21a loaded thereon onto the traverser B. Sprocket wheels 34, 34a and 35, 35a are provided on the support base 26 on the inner side of each of the rails 30, and endless chains 33 and 33a are passed round these sprocket wheels, the shafts of which are rotated from a motor (not shown) provided with brake and clutch. The endless chains 33 and 33a are provided with respective pairs of pawls 36, 36a and 37, 37a which are in phase with one another with respect to the excursion of the endless chains. Meanwhile, the truck A is provided with a hook member projecting sidewise from its bottom extension. When the truck A is brought onto the traverser B, the opposite ends of the hook member 38 are caught between and retained by the pawls of the respective pairs, and with this close coupling the truck A is pulled by the traction force of the chains 33 and 33a. for bringing the pairs of pawls 36, 36a and 37, 37a into their waiting position shown in FIG. 7, a cam 39 is provided on each chain at a position thereof immediately after the succeeding pawl, and a limit switch $LS_1$ adapted to be closed by the cam is provided so that by the operation of this limit switch a brake for stopping the rotation of the sprocket wheels 34 and 35 is actuated to stop the movement of the chains. At the time when the truck A is brought onto the traverser B, it first runs thereonto by its momentum, causing its hook member to be hooked by the pawls as shown in FIG. 8. At this position, one of the front wheels 40 lowers an arm end of a bellcrank lever 41 provided immediately below it, thus closing a limit switch $LS_2$ to couple a clutch (not shown), whereby the truck A is pulled via the sprocket wheels 34 and 25, chains 33 and 33a, hook member and hook pawls.

The position of the new web 21a in the direction of its width is instantly and precisely determined by a single braking made with respect to the drive system for driving the chains 33 and 33a. More particularly, as shown in FIGS. 1, 2, 5 and 9 a photoelectric conversion type detector X, Xa is provided on a line aligned to one end of the web 21 in the state thereof mounted on the reel, and as soon as the light flux incident on the detectors is blocked by the leading end of the new web 21a loaded on the truck A the afore-mentioned brake is actuated to stop the traction of the truck A. The photoelectric conversion type detector X, Xa is provided for an A size web having a large width, and for a D size web having a small width a photoelectric conversion type detector Y, Ya exclusive for this D size web is provided in corresponding positions and adapted to be similarly actuated for effecting the positioning in the direction of width of the web.

Upon completion of the positioning of the new web in the width direction thereof, the traverser B is caused to move from its start position in the direction of the depth of the reel (direction of arrow $F_1$ in FIG. 1), and it is stopped at the following three points, namely a position for removing and collecting the web core 20 after use, a position for positioning the new web 21a in the direction of height of mounting and a position for mounting the new web 21a.

As means for controlling the stopping of the traverser B, a group of limit switches $LS_3$, $LS_4$, $LS_5$ and $LS_6$ are provided on a channel 42, which extends along and parallel to one of the rails 25, at respective predetermined positions, and they are actuated, that is, closed, by a cam 43 provided on the side of the traverser B. The limit switch $LS_3$ is provided for stopping the traverser B at its start position, the limit switch $LS_4$ is provided for the position of removing and collecting the web core after use, the limit switch $LS_5$ is provided for the position for positioning the new web 21a in the direction of mounting height, and the limit switch $LS_6$ is provided for the position of mounting the new web 21a.

First, in response to a light blocking signal from the detector X, Xa or Y Ya for the positioning in the width direction the traverser B is caused to advance along the rails 25 by a motor (not shown) provided with brake and clutch as drive source, and it is moved in a fast feed mode up to a position determined by pulse counting. When the traverser comes close to its stop position, the fast feed is switched to a slow feed mode for controlling its momentum, and upon reaching of a position right beneath the web core 22 remaining between the ends of given mating members of the tri-fulcated arm members held at a predetermined position by the web core receptacle 28 provided on the traverser B on the leading end thereof the contacts of the limit switch LS4 are closed by the cam 43, whereupon the traverser B is stopped.

In case where the web core receptacles 28 and 28*a* are of stationary type, a command for retretreating operation of the center collar 20 is provided immediately with appearance of a stop confirmation signal from the limit switch $LS_4$.

Even where the pair web core receptacles 28 and 28*a* stationarily mounted on the traverser B at the opposite ends thereof and incapable of vertical movement, the web core after use falls onto the traverser B. Thus it is possible to prevent the web core from falling onto floor beneath the reel and rolling thereover, and the web core can be automatically transferred from under the reel onto the traverser B and brought away. However, in this case there still remains some insufficiency for perfect automation until the web core is brought away. In other words, if a mechanism for automatically transferring the web core having fallen onto the web core receptacle onto the truck A loaded on the traverser B is realized, the web core can be brought away totally automatically. In the embodiment illustrated in the drawings, both the web core receptacles 28 and 28*a* are each provided with a perfectly automatic web core transfer means which can cause complex operation of vertical movement and inclination of the receptacle at the same time, and this will now be described in detail.

Figure 3:
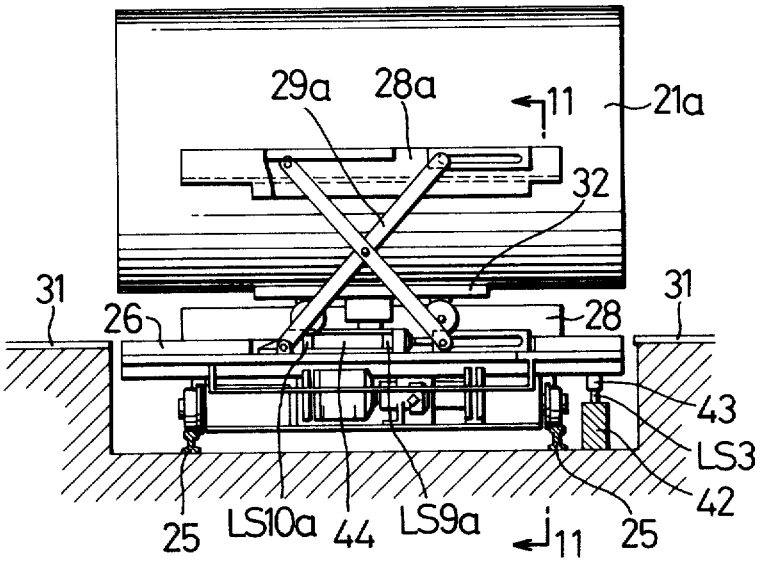
FIG. 3 is a section taken along line 3—3 in FIG. 2 and viewed from the right hand side thereof showing a web core collecting mechanism provided on the second truck (i.e., traverser)

Referring to FIG. 3, a lifter 29*a* of the web core receptacle 28*a* is raised and lowered by the operation of an oil hydraulic cylinder 44, with its raising confirmed by a limit switch $LS_{10a}$ and its lowering confirmed by a limit switch $LS_{9a}$.

Figure 11:
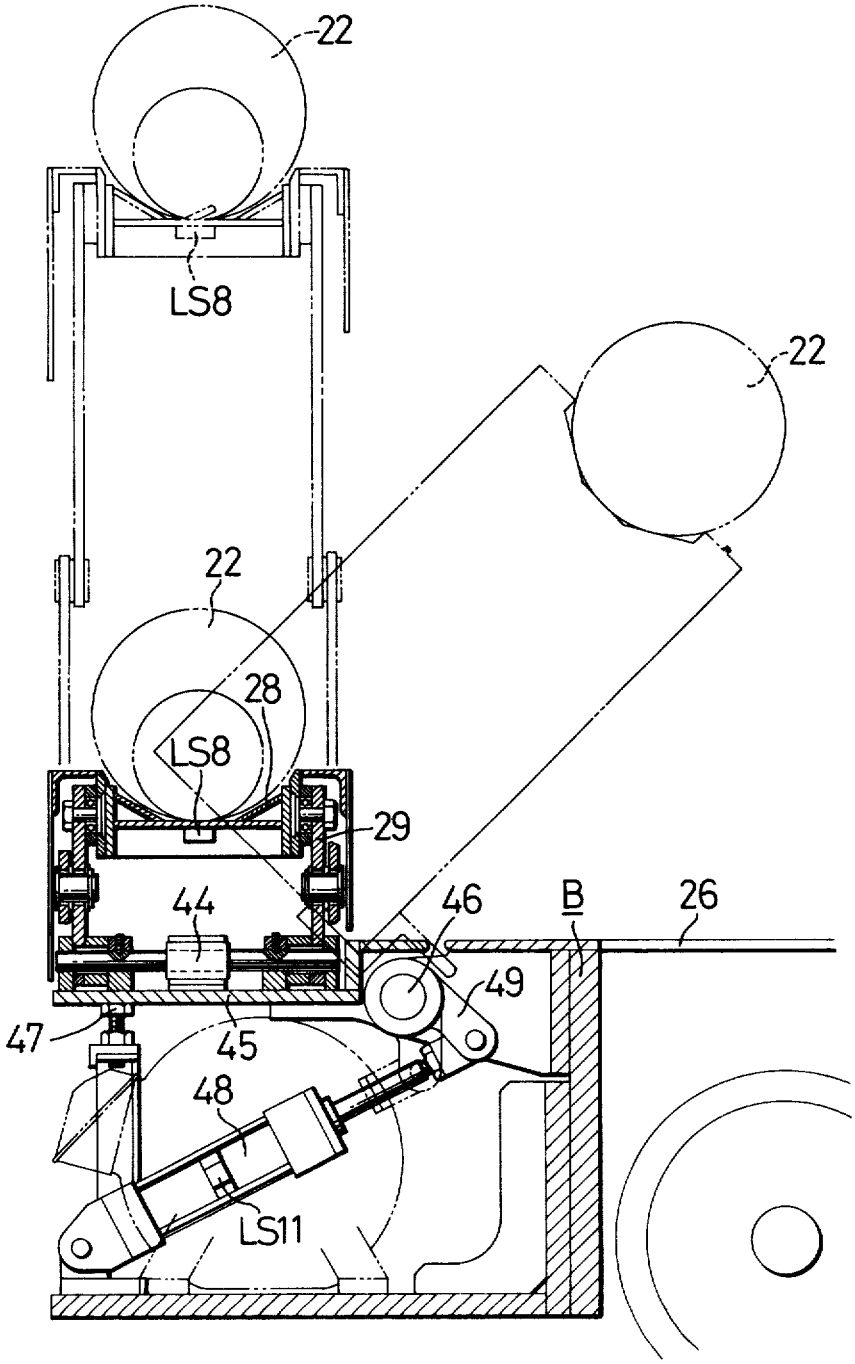
FIG. 11 is a sectional view, to an enlarged scale, taken along line 11—11 in FIG. 3 showing a web core collecting mechanism.
Figure 12:
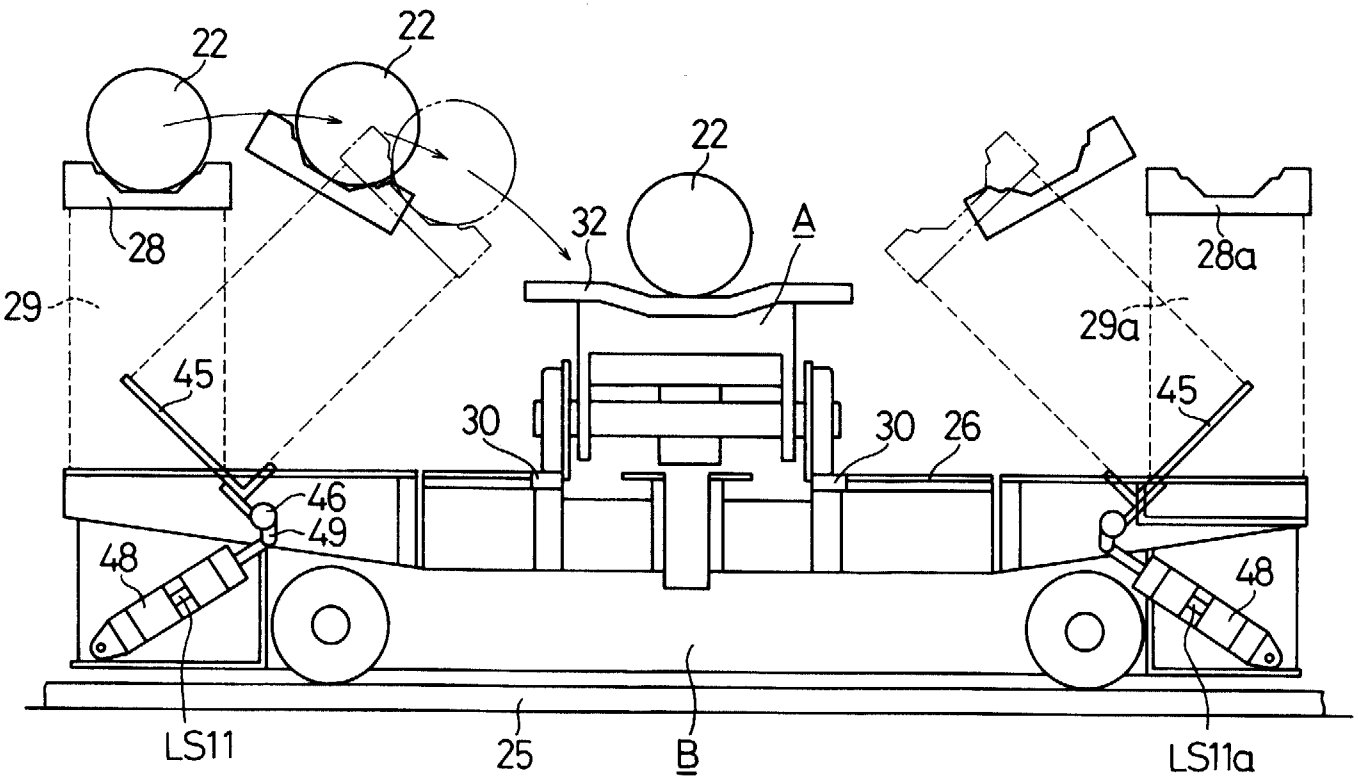
FIG. 12 is a view illustrating operation related to the transfer of a web core after use from each of pair web core collecting mechanisms onto a central base of the first truck.

Referring to FIGS. 2 and 11, web core falling confirmation limit switches $LS_8$ and $LS_{8a}$ are provided on top of the respective web core receptacles 28 and 28*a*.

In FIG. 11, the receptacle 28 is mounted via its lifter 29 on a base 45, which is mounted on top of the traverser B such that it is inwardly tiltable by a pivotable shaft 46 provided on its inside edge. Its upright position is held as the bottom of the base 45 is supported at an outer side position from the underside by a vertical stopper 47. As an end of an arm 49 projecting from the pivotable shaft 46 is displaced by an oil hydraulic cylinder 48, the web core receptacle 28 is inclined to a position shown by a broken line. An approach switch $LS_{11}$ is provided on the oil hydraulic cylinder 48 at a mid position thereof for tentatively stopping the operation of the oil hydraulic cylinder 38 upon confirmation of a slight inclination, for instance one half the total inclination, of the web core receptacle 28 by it. This action is brought about in the initial stage of the step of transferring the web core onto the truck A. This is made so because if the web core receptacle 28 is raised in the vertical direction while the retreat of the traverser B from the position right beneath the new web 21*a* having been mounted on the reel is still insufficient, the web core 22 after use is likely to be touched by a lower portion of the periphery of the mounted new web 21*a* and thus fall down, as shown in (i) in FIG. 13, that is, the afore-mentioned action is brought about for preventing this from happening.

Figure 10:
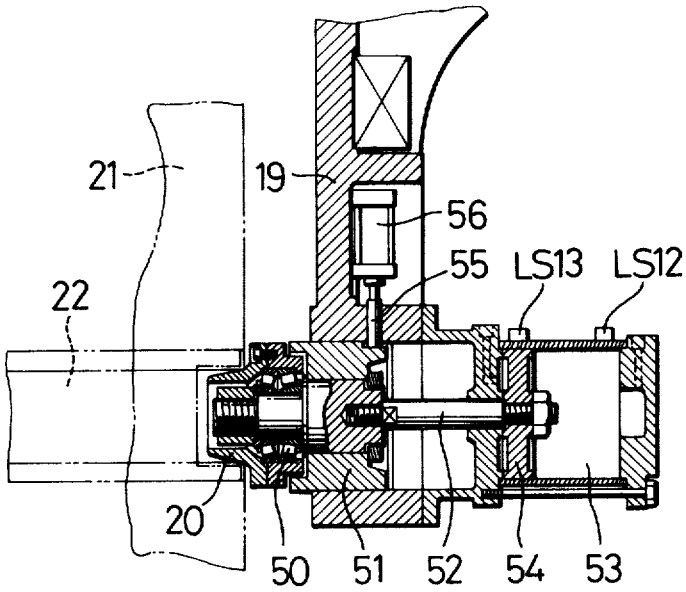
FIG. 10 is a sectional view showing an automatic web mounting and demounting mechanism provided at the end of each arm of each tri-fulcated arm member.

Referring to FIG. 10, each center collar 20 for supporting the core 22 of a web is mounted on the inner side of the end of each arm 19 of the associated tri-fulcated arm member, and it is rotatably supported in a slider 51 via a bearing 50. the slider 51 is received for back-and-forth movement in a hole formed in the end of the arm 19 and is secured to one end of a piston rod 52, which has its other end secured to a piston 54 of an cylinder 53. A pin 55 serves to lock the center collar 20 in the advanced position thereof, and this action is brought about by a small air cylinder 56. Approach switches $LS_{12}$ and $LS_{13}$ for confirmation of advancement and retreat of the center collar 20 respectively are provided on the surface of the air cylinder 53 at positions thereof corresponding to the limits of retreat and advancement of the piston 54.

With appearance of a signal of confirmation of stop of the traverser B from the limit switch $LS_4$ the web core receptacle 29 is lifted by the oil hydraulic cylinder 44, as shown in FIG. 3, and after the lapse of a predetermined period of time provided by a timer $TR_2$ retreat of the center collars 20 holding the web core 22 after use is caused, as shown in FIG. 10. More particularly, each pin 55 is first withdrawn by each air cylinder 56, and then each center collar 20 is retreated by the action of each air cylinder 53, whereby the web core 22 looses its support and thus falls by its own weight onto the web core receptacle 28 (see (c) in FIG. 13). Since the web core receptacle 28 is previously lifted, the distance of fall is very slight, and the web core 22 which is as heavy as 4 to 5 kg can fall and be reliably received by the web core receptacle 28 without producing sound. When a predetermined period of time (provided by a timer $TR_3$) is elapsed from the appearance of a web core fall confirmation signal from a limit switch $LS_8$, the web core receptacle lifter 29 is lowered, and upon completion of descent of the web core receptacle a descent confirmation signal is obtained from a limit switch $LS_9$, thus bringing an end to the operation of removal of the web core after use.

Figure 4:
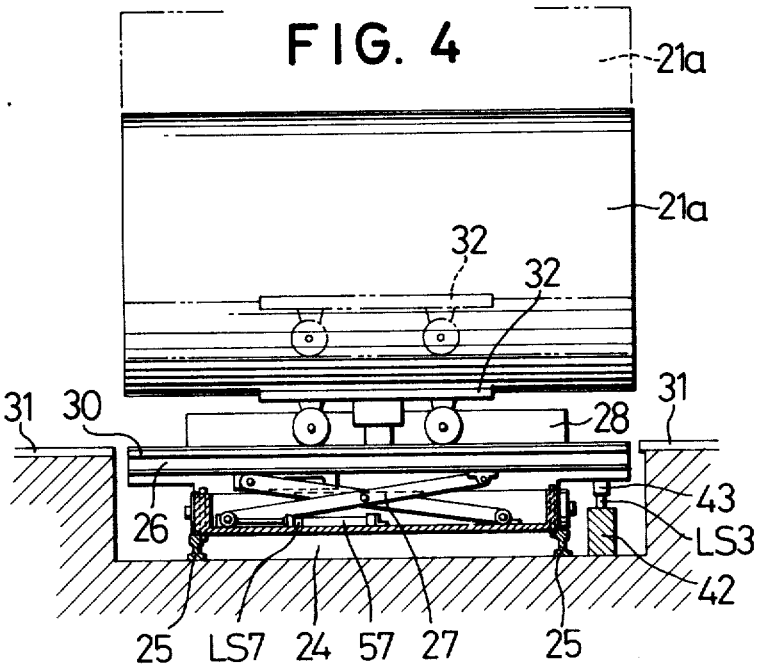
FIG. 4 is a section taken along line 4—4 in FIG. 2 and viewed from the right hand side thereof showing a first truck lifting mechanism provided on the second truck (i.e., traverser)
Figure 5:
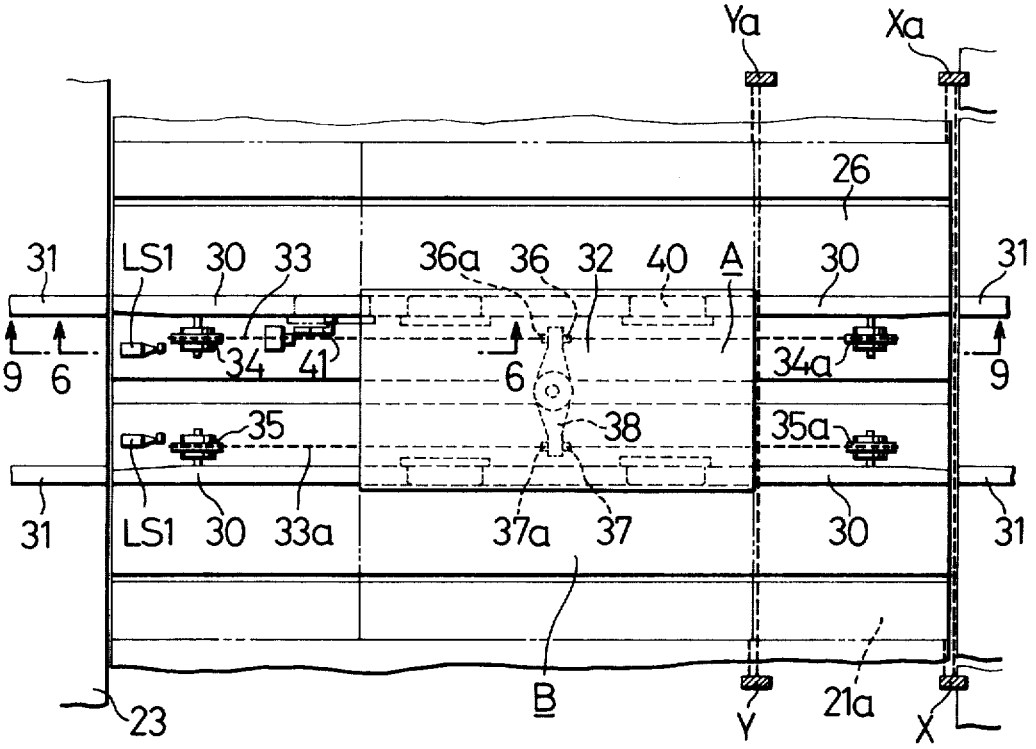
FIGS. 5 to 9 illustrate a mechanism for positioning the first truck brought onto the second truck (i.e. traverser)
Figure 9:
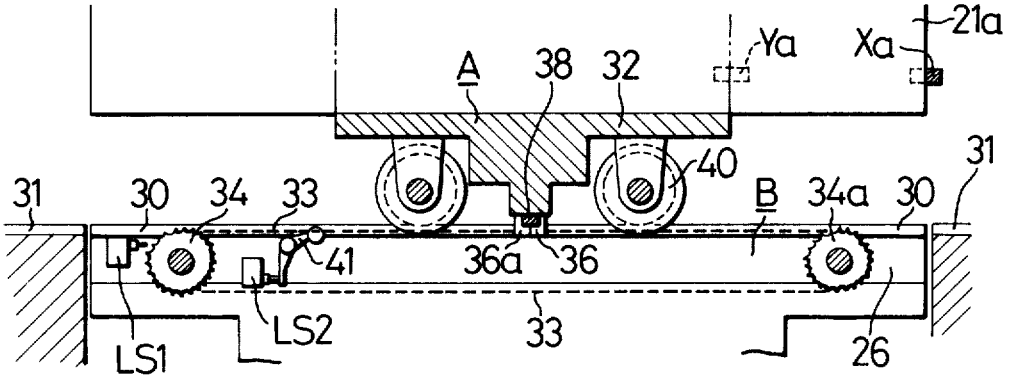
Figure 6:
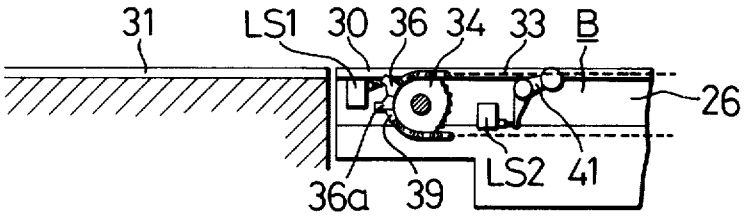
Figure 7:
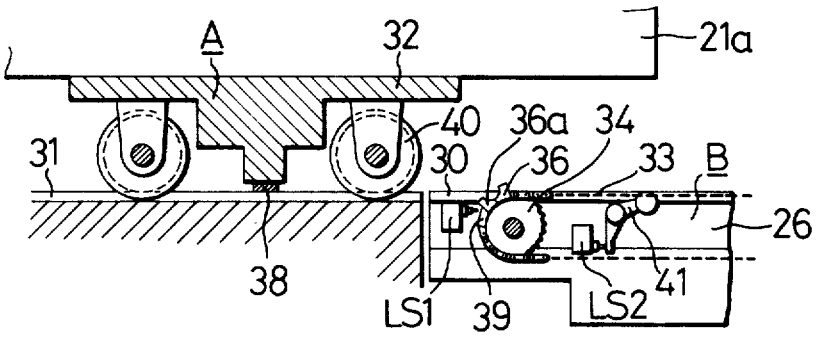
Figure 13A:
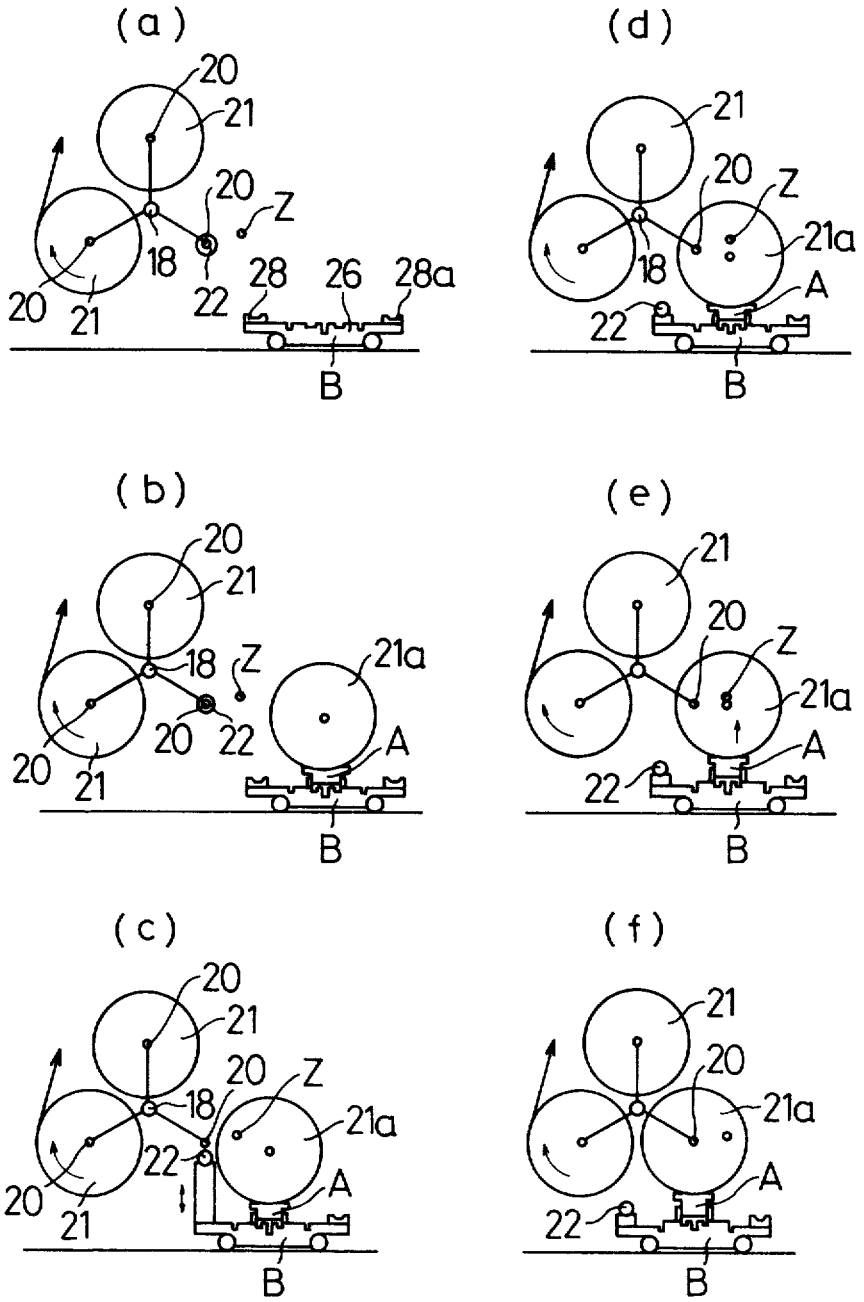
FIGS. 13*a* and 13*b* altogether constituting a sequence diagram showing mutual operation of various parts in one cycle of operation.
Figure 13B:
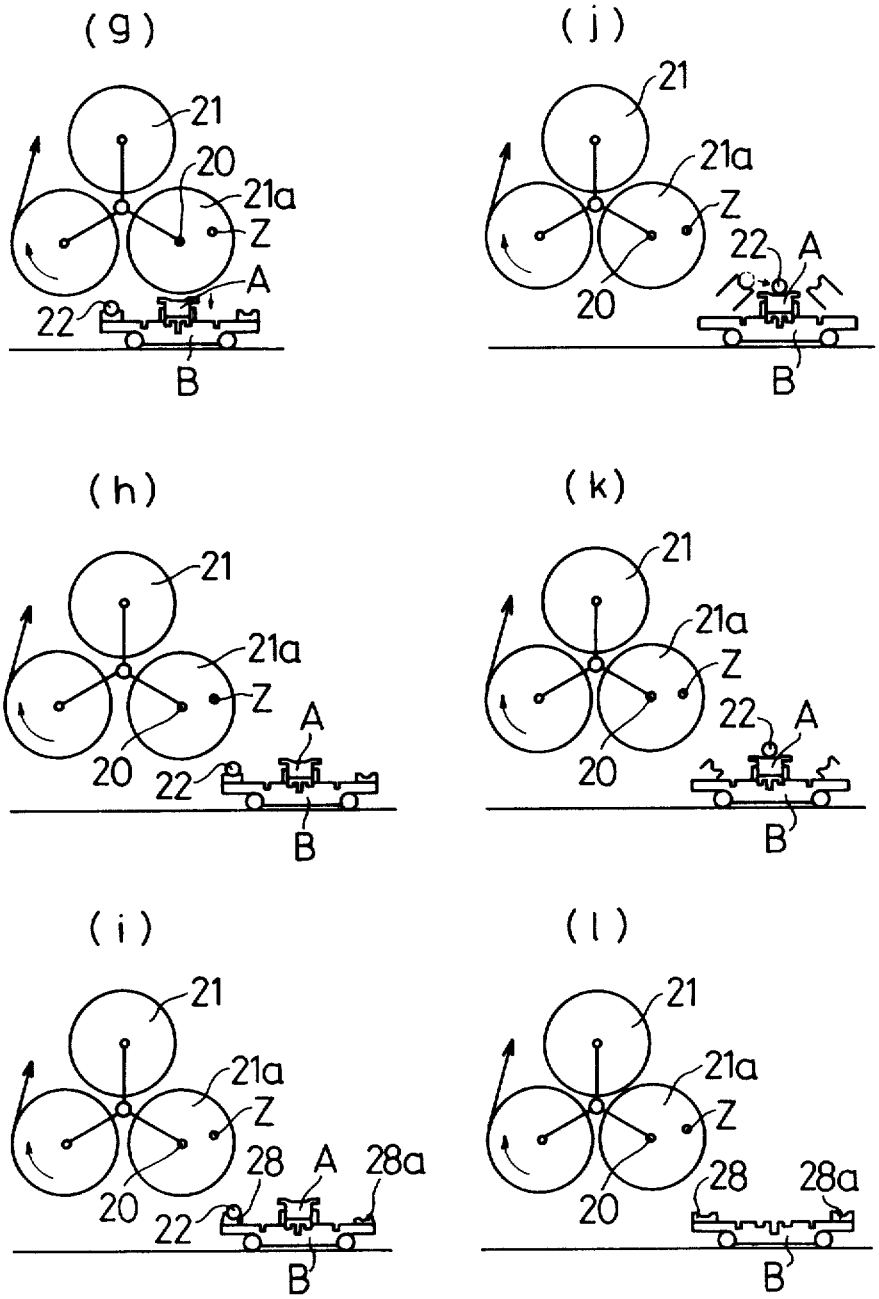

Under the command of the web core fall confirmation signal the traverser B is re-started (to proceed in the direction of arrow F2 in FIG. 1) and is stopped at a position at which the limit switch $LS_5$ for positioning the new web in the direction of height of mounting is actuated by the cam 43, that is, when the center of the traverser B reaches a position right beneath a photoelectric conversion type detector Z, Za disposed in front of and at the same level as the center collar 20 (see (d) in FIG. 13). With a stop confirmation signal from the limit switch $LS_5$ the main lifter 27 is operated by an oil hydraulic cylinder 57 (see FIG. 4) to raise the base 26, on which the truck A with the new web 21*a* loaded thereon is loaded (in the direction of arrow F3 in FIG. 1). The core of the web 21*a* is made of a hollow cylinder, and when the main lifter 27 is raised until the light flux of the photoelectric conversion type detector Z, Za is permitted to penetrate the hollow cylinder, the rising of the main lifter 27 is stopped by a command from the detector, thus completing the positioning of the web in the direction of height of mounting (see (e) in FIG. 13).

With the command from the detector Z, Za for positioning in the direction of height of mounting the traverser B is again re-started (in the direction of arrow F4 in FIG. 1) and is stopped at a position at which the limit switch $LS_6$ for the position of mounting the new web 21a is actuated by the cam 43, that is, when the center of the traverser B reaches the position right beneath the center collars 20 (see (f) in FIG. 13), thus completing the positioning of the new web in the direction of depth of mounting.

With a stop confirmation signal from the limit switch $LS_6$ each oil hydraulic cylinder 53 is actuated to cause advancement of each center collar 20, which coincides with the hollow cylinder of the core of the new web 21a and is precisely inserted thereinto to complete the mounting of the new web (see (f) in FIG. 13).

When a limit switch $LS_{13}$ produces a signal of confirmation of advancement of the center collar 20, the main lifter 27 of the traverser B is lowered (see (g) in FIG. 13), and with a main lifter descent confirmation signal produced from a limit switch $LS_7$ the retreat of the traverser B is caused (see (h) in FIG. 13). With both input signals from the limit switch $LS_7$ for confirmation of descent of main lifter and the limit switch $LS_{13}$ for confirmation of advancement of center collars all the traverser stop limit switches except for the limit switch $LS_3$ for the start position, that is, the limit switches $LS_4$ and $LS_5$, are disconnected from a power source, so that the traverser B can be returned to its start position without being stopped at an intermediate position even the cam 43 acts upon the limit switches during the retreatment of the traverser. Upon reaching of the start position, the limit switch $LS_3$ is actuated to stop the traverser B in its initial position.

In case where the web core receptacles 28 and 28a are of the stationary type, the web core after use is manually transferred from the web core receptacle onto the truck A in the restored position of the traverser, and thereafter the truck A is brought out from the traverser B onto the rails 31. The direction of bringing out the truck need not coincide with the direction of bringing it in.

Figure 14A:
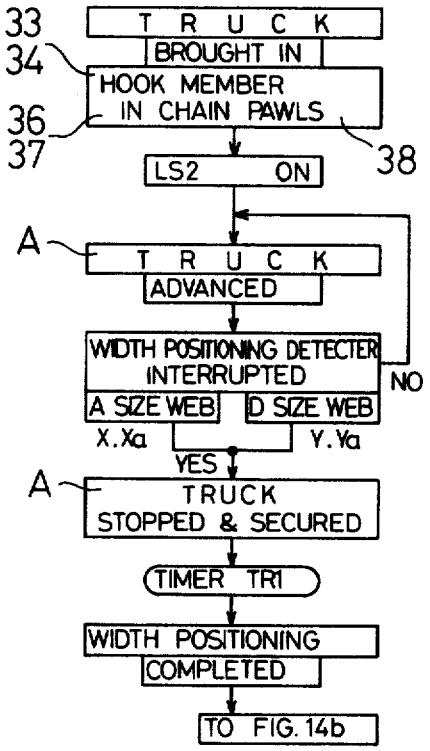
FIGS. 14*a*, 14*b* and 14*c* altogether constituting a flow chart for one cycle of operation.
Figure 14B:
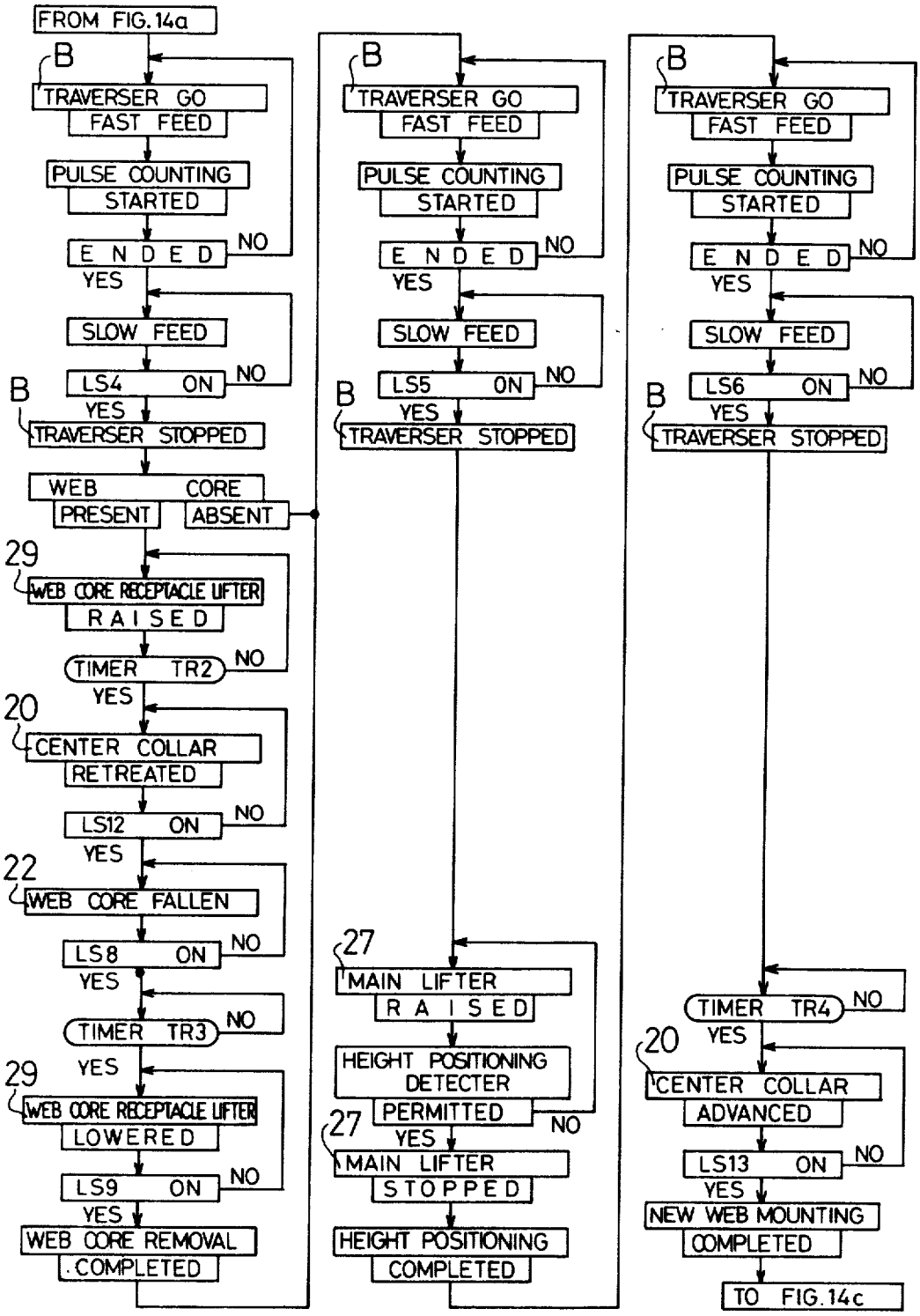
Figure 14C:
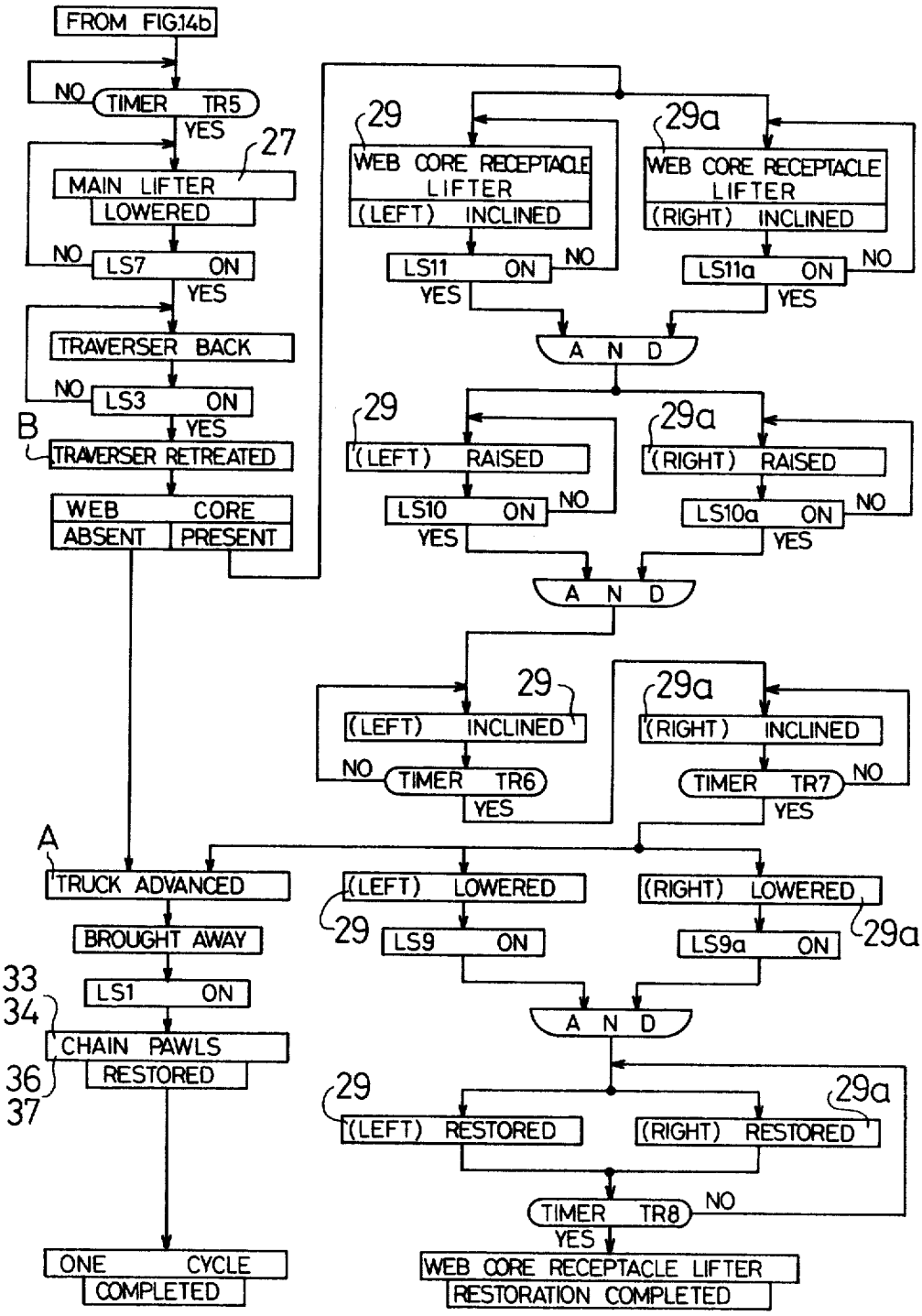

In case where the web core receptacles 28 and 28a are of the type capable of both vertical movement and inclination, automatic transfer of the web core onto the truck A is effected upon retreat of the traverser B (see (i) and (j) in FIG. 13) or after the completion of retreat (see FIG. 14c). Although various modifications may be contemplated in the details of operation, the end of transferring the web core after use received on either web core receptacle 28 or 28a onto the already empty web support base 32 on the truck A is achieved by raising the web core receptacle lifters 29 and 29a then causing inclination of the web core receptacle lifters 29 and 29c in the inward direction.

After completion of the transfer of the web core 22 after use, the web core receptacles 29 and 29a are lowered, and with both input signals from the limit switches $LS_9$ and $LS_{9a}$ for confirmation of descent of the web core receptacles are angularly displaced to the initial position. Simultaneously with the completion of the transfer of the web core after use onto the truck A a command for driving the chains 33 and 34 is produced to bring the truck A onto the rails 31 as described in connection with FIG. 1. When the cam 39 provided immediately after the pawls 36 and 37 on either chain 33 or 34 closes the limit switch $LS_1$, the chains 33 and 34 are stopped to recover their initial start position or waiting position, thus bringing an end to the whole one cycle operation.

In case when there is no web core 22 after use, the operation of collection and transfer of web core is omitted by operating a button (not shown).

Where reels are provided on opposite sides of the traverser, as shown in FIG. 1, the rails 31 are raid such that they encounter a mid position between the reels, to thereby permit furnishing of both the reels with webs by a single traverser B. Designated at 58 and 59 are contact pieces projecting from the opposite ends of the traverser B. They are provided for the sake of safety of the operator such that when they are touched by an operator or other obstacle ahead of the traverser B in the direction of progress thereof, brake is adapted to be immediately applied to the traverser B to stop the same.

Since the invention provides the afore-mentioned construction and operation, it can perfectly automate not only the operations of furnishing of new web and recovery of web core after use, these operations being hitherto effected mostly manually, but also sofisticated care, skill and physical labor required for subtle positioning of the new web in the directions of width, height and depth of mounting the web. Thus, the invention can pronouncedly aid in the promotion of operation efficiency and constitute a factor for greatly promoting the high speed operation of the rotary press.

What is claimed is:

1. An automatic apparatus for furnishing web in a rotary press comprising:

a double truck mechanism for supplying new web, said mechanism consisting of a first truck adapted to move along first rails extending parallel to a reel shaft and support a new web loaded on it and a second truck adapted to move along second rails extending right beneath and at right angles to said reel shaft and said first rails and support said first truck brought and loaded onto it, said second truck being provided with a main lifter for lifting and lowering the loaded first truck;

a pair of web core receptacles provided on said second truck adjacent to the oppsite ends thereof;

a mechanism for mounting and demounting a web core by causing advancement or retreat of center collars provided at mating ends of mating arms of pair tri-fulcated arm members of said reel shaft;

a photoelectric conversion detector means provided such that it is aligned to one end of a web in the state thereof mounted on said reel shaft; a means for positioning the new web in the width direction thereof by restricting the extent to which said first truck is brought onto said second truck in relation to the leading end of the new web when said first truck is brought onto said second truck; a web core collecting means operable by starting said second truck upon completion of the positioning of the new web in the width direction thereof, stopping the second truck when the leading end web core receptacle provided on the second truck reaches a position directly beneath the ends of arms of tri-fulcated arm members previously held in a predetermined waiting position and then causing retreat of center collars on the ends of the arms under the control of a stop confirmation signal to thereby cause the web core to fall onto said web core receptacle; a means for determining the height of the new web by re-starting the second truck under the control of a web core fall confirmation signal, stopping the second truck when the second truck reaches a position right beneath said photoelectric conversion detector means provided in front of and at the same level as said center collars, then raising said main lifter under the control of a stop confirmation signal and stopping the rising of said main lifter upon reaching of a predetermined relation of the hollow cylinder of the core of said new web on said lifter to the level of said detector means; a means for determining the position of said new web in the direction of depth of mounting of the new web by repeatedly causing re-start of said second truck under the control of a signal from said photoelectric conversion type detector means and stopping the second truck when the center of the second truck reaches a position right beneath said center collars; a new web mounting means for causing advancement of said center collars under the control of a stop confirmation signal; and a restoring means for lowering the main lifter by a center collar advancement signal, causing the retreat of the second truck under the control of a lifter descent confirmation signal, stopping the second truck upon restoration of the main lifter to the start position and bringing the first truck out of the second truck under the control of a restoration confirmation signal.

2. An automatic apparatus for furnishing web in a rotary press comprising:

a double truck mechanism for supplying new web, said mechanism consisting of a first truck adapted to move along first rails extending parallel to a reel shaft and support a new web loaded on it and a second truck adapted to move along second rails extending right beneath and at right angles to said reel shaft and said first rails and support said first truck brought and loaded onto it, said second truck being provided with a main lifter for lifting and lowering the loaded first truck;

a pair of web core collecting mechanisms provided on said second truck adjacent to the opposite ends thereof, each said web core collecting mechanism including a web core receptacle, a lifter for lifting and lowering said web core receptacle and a tilting means for causing inward rotation of said lifter about a stem portion thereof by a predetermined inclination angle;

a mechanism for mounting and demounting a web core by causing advancement or retreat of center collars provided at mating ends of mating arms of pair tri-fulcated arm members of said reel shaft;

a photoelectric conversion detector means provided such that it is aligned to one end of a web in the state thereof mounted on said reel shaft; a means for positioning the new web in the width direction thereof by restricting the extent to which said first truck is brought onto said second truck in relation to the leading end of the new web when said first truck is brought onto said second truck; a web core collecting means operable by starting said second truck upon completion of the positioning of the new web in the width direction thereof, stopping the second truck when the leading end side web core receptacle provided on the second truck reaches a position directly beneath the ends of arms of tri-fulcated arm members previously held in a predetermined waiting position and then causing retreat of center collars on the ends of the arms under the control of a stop confirmation signal to thereby cause the web core to fall onto said web core receptacle; a means for determining the height of the new web by re-starting the second truck under the control of a web core fall confirmation signal, stopping the second truck when the second truck reaches a position right beneath said photoelectric conversion detector means provided in front of an at the same level as said center collars, then raising said main lifter under the control of a stop confirmation signal and stopping the rising of said main lifter upon reaching of a predetermined relation of the hollow cylinder of the core of said new web on said lifter to the level of said detector means; a means for determining the position of said new web in the direction of depth of mounting of the new web by repeatedly causing re-start of said second truck under the control of a signal from said photoelectric conversion type detector means and stopping the second truck when the center of the second truck reaches a position right beneath said center collars; a new web mounting means for causing advancement of said center collars under the control of a stop confirmation signal; and a restoring means for lowering the main lifter by a center collar advancement signal, causing the retreat of the second truck under the control of a lifter descent confirmation signal, stopping the second truck upon restoration of the main lifter to the start position, raising the lifters of the pair web core receptacles under the control of a restoration confirmation signal, inwardly tilting the lifters under the control of a raising confirmation signal to thereby transfer the web cores from the web core receptacles onto the main lifter on the second truck and bringing the first truck out of the second truck under the control of a tilting confirmation signal.

3. The automatic apparatus for furnishing web in a rotary press according to claim 1, which further comprises means for relating said first truck to said second truck by bringing said first truck onto said second truck, said relating means including an endless chain means provided on said second truck and extending in the direction, in which said first truck is brought onto said second truck, said endless chain means being driven by a motor provided with a brake and having two pawl means and a hook member projecting from the underside of said first truck, said hook member being adapted to be caught between and retained by said two pawl means at the tiem when said first truck is brought onto said second truck, thereby causing traction of said first truck by said endless chain means to provide reliable transmission of drive power free from loss thereof between the two coupled members and thus ensure precise positioning of the new web in the width direction thereof.

4. The automatic apparatus for furnishing web in a rotary press according to claim 1, which further comprises a safety mechanism including contact pieces each projecting from each end of said second truck, the progress of said second truck being adapted to be stopped with deformation of said contact pieces.

5. The automatic apparatus for furnishing web in a rotary press according to claim 1, which further comprises second rails for bringing said first truck onto said second truck, said second rails being provided at right mid position of said first-mentioned rails, said mid point constituting a start position of said second truck, thus permitting automatic supply of webs to reels on opposite sides of said second truck with said double truck mechanism.

6. The automatic apparatus for furnishing web in a rotary press according to claim 1, wherein in the process of control for transferring the web core from the web core receptacle onto the main lifter a slight angular displacement of each web core receptacle lifter toward the inner side is caused prior to the stage of raising each web core receptacle lifter, thereby avoiding impingement of the web core receptacle lifter with the new web at the time of lifting the web core receptacle.

7. The automatic apparatus for furnishing web in a rotary press according to claim 1, which further comprises means for stopping said second truck, said stopping means including a group of limit switches arranged in a row along a channel provided on a frame and extending parallel to said rails and a cam provided on said second truck and to successively operate said limit switches.

8. The automatic apparatus for furnishing web in a rotary press according to claim 1, which further comprises an additional photoelectric conversion type detector means for positioning a new web having a different width in the width direction of the new web, thus permitting the supply of the new web of the different width by switching the photoelectric conversion type detector means over to said addition one.

9. The automatic apparatus for furnishing web in a rotary press according to claim 1, which further comprises lock pin means adapted to be actuated upon reaching of the limit advancement position of the center collars at the ends of the arms of the tri-fulcated arm members.

10. The automatic apparatus for furnishing web in a rotary press according to claim 1, wherein the individual component parts are arranged such that the operation of determining the height of the new web and the operation of causing the web core to fall onto the associated web core receptacle are executed at the same stationary position of the second truck.

11. The automatic apparatus for furnishing web in a rotary press according to claim 1, which further comprises a control mechanism for the control operation of transferring the web core on the web core receptacle onto the first truck to be executed concurrently with the operation of effecting the retreat of the second truck to the initial position.

12. The automatic apparatus for furnishing web in a rotary press according to claim 2, which further comprises means for relating said first truck to said second truck by bringing said first truck onto said second truck, said relating means including an endless chain means provided on said second truck and extending in the direction, in which said first truck is brought onto said second truck, said endless chain means being driven by a motor provided with a brake and having two pawl means and a hook member projecting from the underside of said first truck, said hook member being adapted to be caught between and retained by said two pawl means at the time when said first truck is brought onto said second truck, thereby causing traction of said first truck by said endless chain means to provide reliable transmission of drive power free from loss thereof between the two coupled members and thus ensure precise positioning of the new web in the width direction thereof.

13. The automatic apparatus for furnishing web in a rotary press according to claim 2, which further comprises a safety mechanism including contact pieces each projecting from each end of said second truck, the progress of said second truck being adapted to be stopped with deformation of said contact pieces.

14. The automatic apparatus for furnishing web in a rotary press according to claim 2, which further comprises second rails for bringing said first truck onto said second truck, said second rails being provided at right mid position of said first-mentioned rails, said mid point constituting a start position of said second truck, thus permitting automatic supply of webs to reels on opposite sides of said second truck with said double truck mechanism.

15. The automatic apparatus for furnishing web in a rotary press according to claim 2, wherein in the process of control for transferring the web core from the web core receptacle onto the main lifter a slight angular displacement of each web core receptacle lifter toward the inner side is caused prior to the stage of raising each web core receptacle lifter, thereby avoiding inpingement of the web core receptacle lifter with the new web at the time of lifting the web core receptacle.

16. The automatic apparatus for furnishing web in a rotary press according to claim 2, which further comprises means for stopping said second truck, said stopping means including a group of limit switches arranged in a row along a channel provided on a frame and extending parallel to said rails and a cam provided on said second truck and to successively operate said limit switches.

17. The automatic apparatus for furnishing web in a rotary press according to claim 2, which further comprises an additional photoelectric conversion type detector means for positioning a new web having a different width in the width direction of the new web, thus permitting the supply of the new web of the different width by switching the photoelectric conversion type detector means over to said additional one.

18. The automatic apparatus for furnishing web in a rotary press according to claim 2, which further comprises lock pin means adapted to be actuated upon reaching of the limit advancement position of the center collars at the ends of the arms of the tri-fulcated arm members.

19. The automatic apparatus for furnishing web in a rotary press according to claim 2, wherein the individual component parts are arranged such that the operation of determining the height of the new web and the operation of causing the web core to fall onto the associated web core receptacle are executed at the same stationary position of the second truck.

20. The automatic apparatus for furnishing web in a rotary press according to claim 2, which further comprises a control mechanism for the control operation of transferring the web core on the web core receptacle onto the first truck to be executed concurrently with the operation of effecting the retreat of the second truck to the initial position.

* * * * *